US011357292B2

(12) United States Patent
Akao

(10) Patent No.: US 11,357,292 B2
(45) Date of Patent: Jun. 14, 2022

(54) ZIPPER TAPE AND ZIPPER TAPE-EQUIPPED CONTAINER

(71) Applicant: IDEMITSU UNITECH CO., LTD., Tokyo (JP)

(72) Inventor: Taishiro Akao, Chiba (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 0 days.

(21) Appl. No.: 17/278,404

(22) PCT Filed: Sep. 24, 2019

(86) PCT No.: PCT/JP2019/037263
§ 371 (c)(1),
(2) Date: Mar. 22, 2021

(87) PCT Pub. No.: WO2020/067008
PCT Pub. Date: Apr. 2, 2020

(65) Prior Publication Data

US 2021/0353013 A1 Nov. 18, 2021

(30) Foreign Application Priority Data

Sep. 27, 2018 (JP) ..... JP2018-181737

(51) Int. Cl.
*A44B 19/34* (2006.01)
*B65D 33/25* (2006.01)
*A44B 19/16* (2006.01)

(52) U.S. Cl.
CPC ..... *A44B 19/34* (2013.01); *B65D 33/2508* (2013.01); *B65D 33/2541* (2013.01); *A44B 19/16* (2013.01)

(58) Field of Classification Search
CPC ..... A44B 19/34; A44B 19/16; B65D 33/25; B65D 33/2508; B65D 33/2541
See application file for complete search history.

(56) References Cited

U.S. PATENT DOCUMENTS 5,185,909 A * 2/1993 Inagaki ..... B65D 33/2541 24/585.12
5,700,091 A * 12/1997 Tanaka ..... B32B 27/08 383/63

(Continued)

FOREIGN PATENT DOCUMENTS

JP 200918052 A 1/2009
JP 5410291 B 2/2014

(Continued)

OTHER PUBLICATIONS

International Search Report for PCT/JP2019/037263 dated Dec. 17, 2019.

(Continued)

*Primary Examiner* — Robert Sandy
(74) *Attorney, Agent, or Firm* — Millen, White, Zelano & Branigan, PC; Ryan Pool

(57) ABSTRACT

A zipper tape having an elongated shape includes, in a cross-sectional shape thereof: a pair of base strips; and engagement portions projecting from respective opposing surfaces of the pair of base strips and being engageable with each other, in which at least the engagement portions each are formed with a resin composition including polypropylene, the resin composition having fusion enthalpy $\Delta H_{120}$ in a temperature range of higher than or equal to 120 degrees C. measured by differential scanning calorimetry (DSC) of less than 30 J/g, and has tensile modulus of elasticity of less than or equal to 600 MPa.

8 Claims, 4 Drawing Sheets

(56) References Cited

U.S. PATENT DOCUMENTS

| | | | | |
|---|---|---|---|---|
| 5,955,160 | A * | 9/1999 | Tanaka | B65D 33/2541 428/33 |
| 7,765,649 | B2 * | 8/2010 | Katada | B65D 33/2533 24/585.12 |
| 2010/0220940 | A1 | 9/2010 | Katada et al. | |

FOREIGN PATENT DOCUMENTS

| | | | |
|---|---|---|---|
| WO | 2004024582 | A2 | 3/2004 |
| WO | 2009054313 | A1 | 4/2009 |

OTHER PUBLICATIONS

English Machine Translation of JP2009018052, Publication Date: Jan. 29, 2009.

* cited by examiner

ZIPPER TAPE AND ZIPPER TAPE-EQUIPPED CONTAINER

TECHNICAL FIELD

The present invention relates to a zipper tape and a container equipped with a zipper tape.

BACKGROUND ART

Processes of manufacturing a bag equipped with a zipper tape generally include a side sealing process in which films each having a zipper tape bonded thereto are opposed to each other and parts corresponding to both sides of the bag are sealed inclusive of the zipper tapes. In this case, a bonding failure in an engagement portion of the zipper tape projecting from an inner surface of the film can generate pinholes which deteriorate a sealing property of the bag. Accordingly, a point sealing process is performed in which the engagement portion of the zipper tape is deformed into a flat shape in advance, prior to forming a side seal portion.

However, the point sealing process sometimes has been a speed limitation of the manufacturing processes. Increasing temperature of the point sealing makes it possible to shorten time taken for the process. In a case where heat resistance of the film is low, however, increase in the temperature is limited because of wrinkles being generated. In particular, in a case where the engagement portion of the zipper tape is formed with polypropylene, a high melting point of polypropylene leads to longer time taken for the point sealing process, which results in large speed constraints in the manufacturing processes.

In this regard, Patent Literature 1 describes a technique that prevents, in a packaging bag equipped with a zipper tape having aluminum foil therein, generation of wrinkles during heat sealing and aluminum crack in a point sealing process, by forming a base of the zipper tape with a resin having higher tensile modulus of elasticity than tensile modulus of elasticity of an engagement portion.

CITATION LIST

Patent Literature(s)

Patent Literature 1: JP 5410291 B

SUMMARY OF THE INVENTION

Problem(s) to be Solved by the Invention

However, the above-described Patent Literature 1 is a technique for preventing the generation of wrinkles and the aluminum crack in the packaging bag equipped with the zipper tape having the aluminum foil therein, and does not address the above-described issue that it takes longer to perform the point sealing process in the case where the engagement portion of the zipper tape is formed with polypropylene.

Accordingly, an object of the invention is to provide a zipper tape and a container equipped with a zipper tape which are novel and improved and which make it possible to shorten time taken for a point sealing process to be performed on a side seal portion or to omit the point sealing process in a case where an engagement portion of the zipper tape is formed with a resin containing polypropylene.

Means for Solving the Problem(s)

According to an aspect of the invention, a zipper tape having an elongated shape includes, in a cross-sectional shape thereof: a pair of base strips; and engagement portions projecting from respective opposing surfaces of the pair of base strips and being engageable with each other, in which at least the engagement portions each are formed with a resin composition including polypropylene, the resin composition having fusion enthalpy $\Delta H_{120}$ in a temperature range of higher than or equal to 120 degrees C. measured by differential scanning calorimetry (DSC) of less than 30 J/g, and having tensile modulus of elasticity of less than or equal to 600 MPa.

In the above-described zipper tape, the fusion enthalpy $\Delta H_{120}$ may be less than 30 J/g and the tensile modulus of elasticity may be less than or equal to 500 MPa, or the fusion enthalpy $\Delta H_{120}$ may be less than 20 J/g and the tensile modulus of elasticity may be less than or equal to 600 MPa. Alternatively, the fusion enthalpy $\Delta H_{120}$ may be greater than 20 J/g and less than 30 J/g and the tensile modulus of elasticity may be greater than or equal to 100 MPa and less than or equal to 500 MPa, or the fusion enthalpy $\Delta H_{120}$ may be greater than 5 J/g and less than or equal to 20 J/g and the tensile modulus of elasticity may be greater than or equal to 100 MPa and less than or equal to 600 MPa.

Further, in the above-described zipper tape, the resin composition may further include a modifier. The modifier may include an ethylene-propylene rubber (EPR). Moreover, at least a part of the base strips may be formed with a resin composition that is different from the resin composition forming the engagement portions.

According to another aspect of the invention, a container equipped with a zipper tape includes: the above-described zipper tape; and a container body to which the zipper tape is bonded. The container body may form a bag body.

According to the above-described configuration, a flattening property of the engagement portions of the zipper tape is improved. This makes it possible to shorten the time taken for the point sealing process to be performed on the side seal portion or to omit the point sealing process in the case where the engagement portions each are formed with a resin including polypropylene.

BRIEF DESCRIPTION OF DRAWING(S)

DESCRIPTION OF EMBODIMENT(S)

The following describes preferred exemplary embodiments of the invention in detail with reference to the accompanying drawings. It is to be noted that, in this description and the accompanying drawings, components that have substantially the same functional configuration are indicated by the same reference signs, and thus redundant description thereof is omitted.

First Exemplary Embodiment

Figure 1:
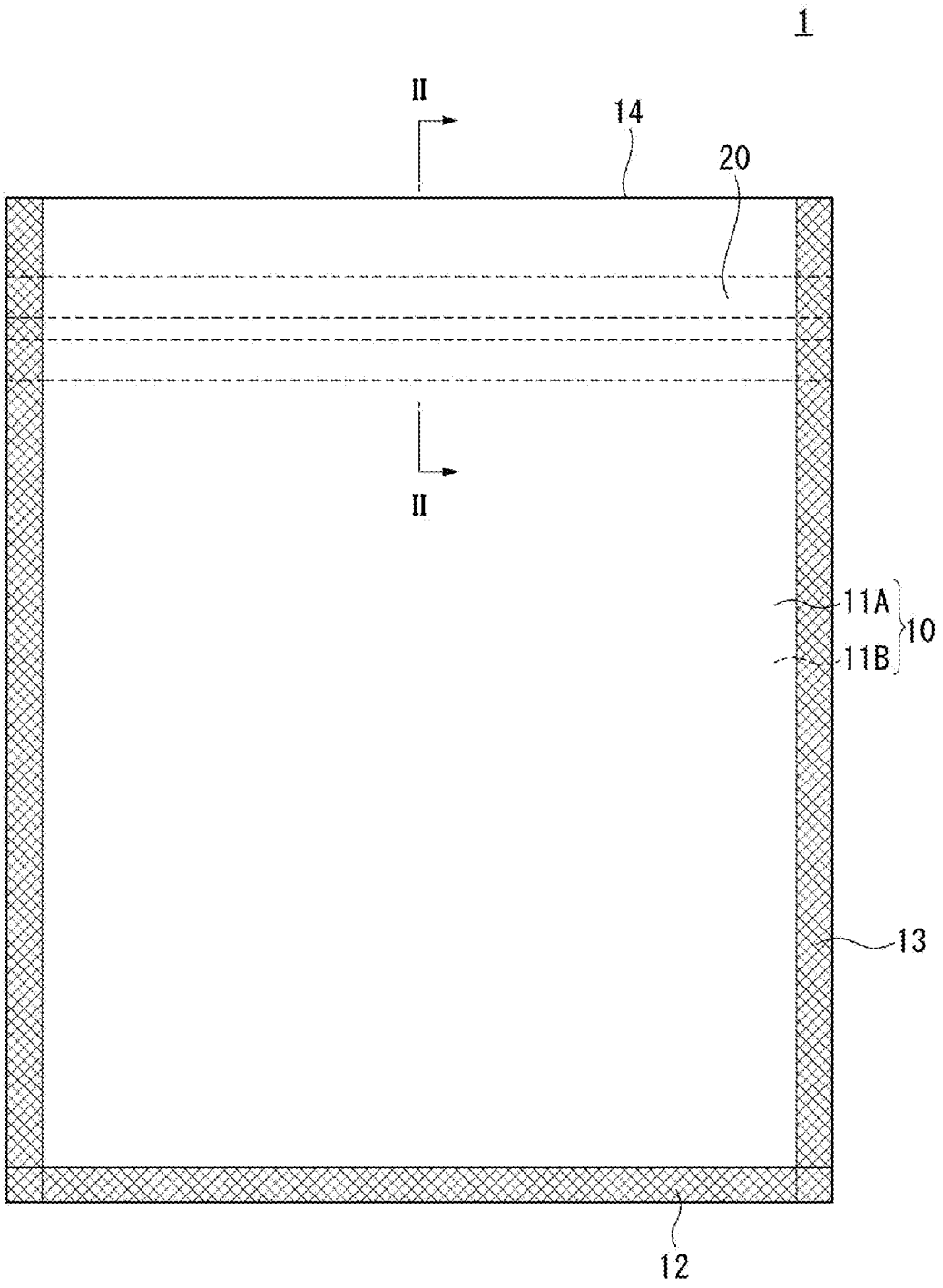
FIG. 1 is a plan view of a bag equipped with a zipper tape according to a first exemplary embodiment of the invention.
Figure 2:
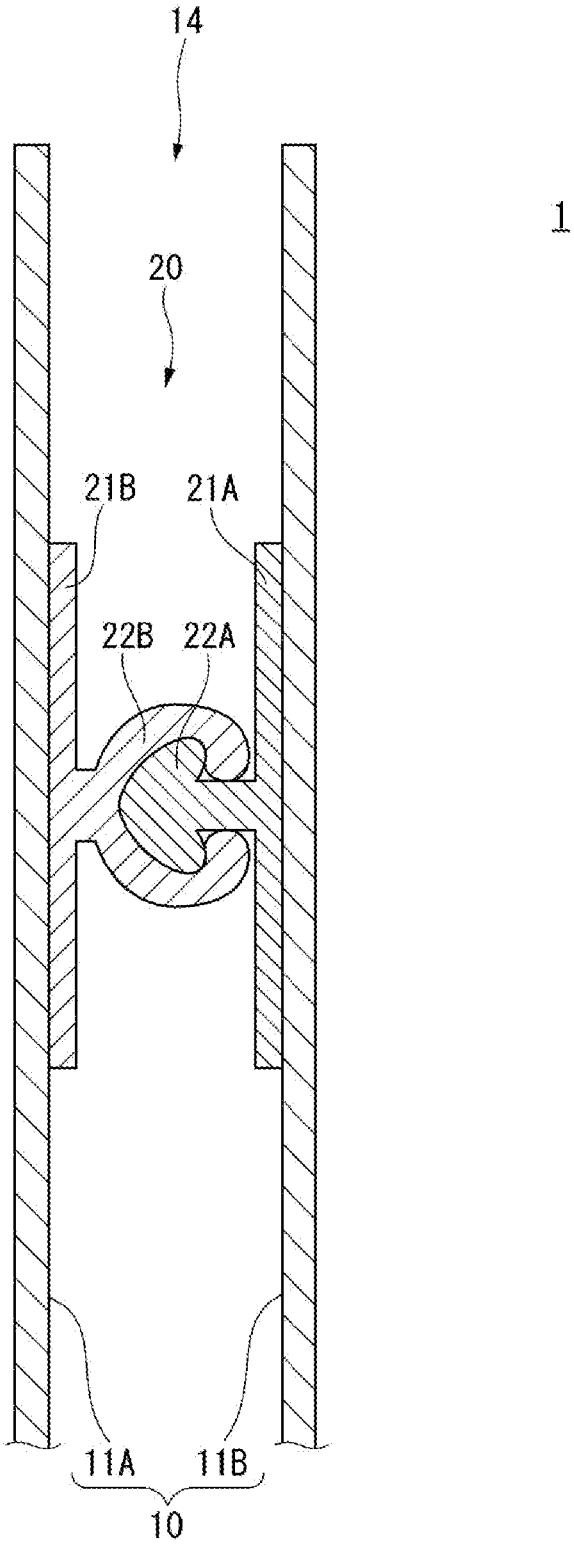
FIG. 2 is a cross-sectional view taken along a line II-II of the bag equipped with the zipper tape illustrated in FIG. 1.

FIG. 1 is a plan view of a bag equipped with a zipper tape according to a first exemplary embodiment of the invention. FIG. 2 is a cross-sectional view taken along a line II-II of the bag equipped with the zipper tape illustrated in FIG. 1. As illustrated in FIGS. 1 and 2, a bag 1 equipped with a zipper tape according to the first exemplary embodiment includes: a film 10 that forms a bag body having a first side 11A and a second side 11B; and a zipper tape 20.

The film 10 is a container body according to the present exemplary embodiment, and is formed with, for example, a single-layer or multi-layer thermoplastic resin. More specifically, the film 10 may include a layer formed with low density polyethylene (LDPE), linear low density polyethylene (LLDPE), or polypropylene (PP). The PP may be polypropylene homopolymer (HPP), polypropylene random copolymer (RPP), or polypropylene block copolymer (BPP). In a case where the film 10 is multi-layered, biaxially oriented polypropylene (OPP), biaxially oriented polyethylene terephthalate (OPET), or biaxially oriented nylon (ONy) may be used for a surface base. The film 10 may include a layer of an inorganic material formed by, for example, aluminum vapor deposition or laminating of aluminum foil.

In the present exemplary embodiment, the bag body having the first side 11A and the second side 11B is formed by bonding two films 10 to each other at a bottom seal portion 12 and a side seal portion 13. However, in another exemplary embodiment, the first side 11A and the second side 11B may be provided by folding a single film 10 at a part corresponding to the side seal portion 13. Alternatively, a part in which the film 10 is folded inward, that is, a so-called gusset, may be formed in a part corresponding to the bottom seal portion 12 or the side seal portion 13 in the example illustrated in FIG. 1. In this case, the gusset may be formed by the film 10 or by another film bonded to the film 10. The bag 1 equipped with the zipper tape may also be a stand up pouch which is able to be placed upright on a gusset being formed at a bottom of the bag 1.

In the present exemplary embodiment, while the bottom seal portion 12 and the side seal portion 13 are formed, an opening 14 of the bag 1 equipped with the zipper tape is provided by not forming a top seal portion. However, in another exemplary embodiment, the bag 1 equipped with the zipper tape may have the top seal portion formed in addition to the bottom seal portion 12 and the side seal portion 13, and the opening 14 may be provided afterward by cutting a portion between the top seal portion and the zipper tape 20. In yet another exemplary embodiment, the bag body may be provided without the bottom seal portion 12, i.e., the bag 1 equipped with the zipper tape need not be sealed on an opposite side from the zipper tape 20. In this case, the bottom seal portion 12 is formed after the bag 1 equipped with the zipper tape is filled with contents. In addition, as long as a zipper tape is fused thereto, it is possible to provide the container equipped with the zipper tape according to an exemplary embodiment of the invention, by bonding the zipper tape to a bag having various known configurations or to a container other than the bag.

As illustrated in FIG. 2, the zipper tape 20 is an elongated member including, in a cross-sectional shape thereof: a pair of base strips 21A and 21B respectively bonded to the first side 11A and the second side 11B of the film 10; and engagement portions 22A and 22B that project from respective opposing surfaces of the base strips 21A and 21B and that are engageable with each other. In the illustrated example, the engagement portion 22A has a male cross-sectional shape and the engagement portion 22B has a female cross-sectional shape. The engagement portions 22A and 22B are engaged with each other to thereby close the zipper tape 20 and seal the opening 14 of the bag 1 equipped with the zipper tape. It is to be noted that the invention is not limited to the male shape and the female shape, and it is also possible to apply, to the engagement portions 22A and 22B of the above example, various shapes of engagement portions of known zipper tapes having a combination of a claw shape, a hook shape, a knob shape, or the like.

In the present exemplary embodiment, the base strips 21A and 21B and the engagement portions 22A and 22B of the zipper tape 20 each are formed with a resin composition including polypropylene. Specifically, polypropylene contained in the resin composition is, for example, polypropylene random copolymer (RPP). The resin composition has fusion enthalpy $\Delta H_{120}$ in a temperature range of higher than or equal to 120 degrees C. measured by differential scanning calorimetry (DSC) to be described below of less than 30 J/g and tensile modulus of elasticity of less than or equal to 600 MPa. The $\Delta H_{120}$ is preferably less than or equal to 25 J/g, and more preferably less than or equal to 20 J/g. The $\Delta H_{120}$ of less than 30 J/g further improves the flattening property. Although a lower limit of the $\Delta H_{120}$ is not particularly limited, the $\Delta H_{120}$ is greater than or equal to 5 J/g in normal cases. Regarding a combination of the $\Delta H_{120}$ and the tensile modulus of elasticity, it is preferable that the tensile modulus of elasticity is less than or equal to 500 MPa in a case where the $\Delta H_{120}$ is greater than 20 J/g and less than 30 J/g, and it is preferable that the tensile modulus of elasticity is less than or equal to 600 MPa in a case where the $\Delta H_{120}$ is less than or equal to 20 J/g. The tensile modulus of elasticity is preferably less than or equal to 400 MPa, and more preferably less than or equal to 350 MPa. The tensile modulus of elasticity of less than or equal to 600 MPa further improves the flattening property. Although a lower limit of the tensile modulus of elasticity is not particularly limited, the tensile modulus of elasticity is greater than or equal to 100 MPa in normal cases.

Figure 3:
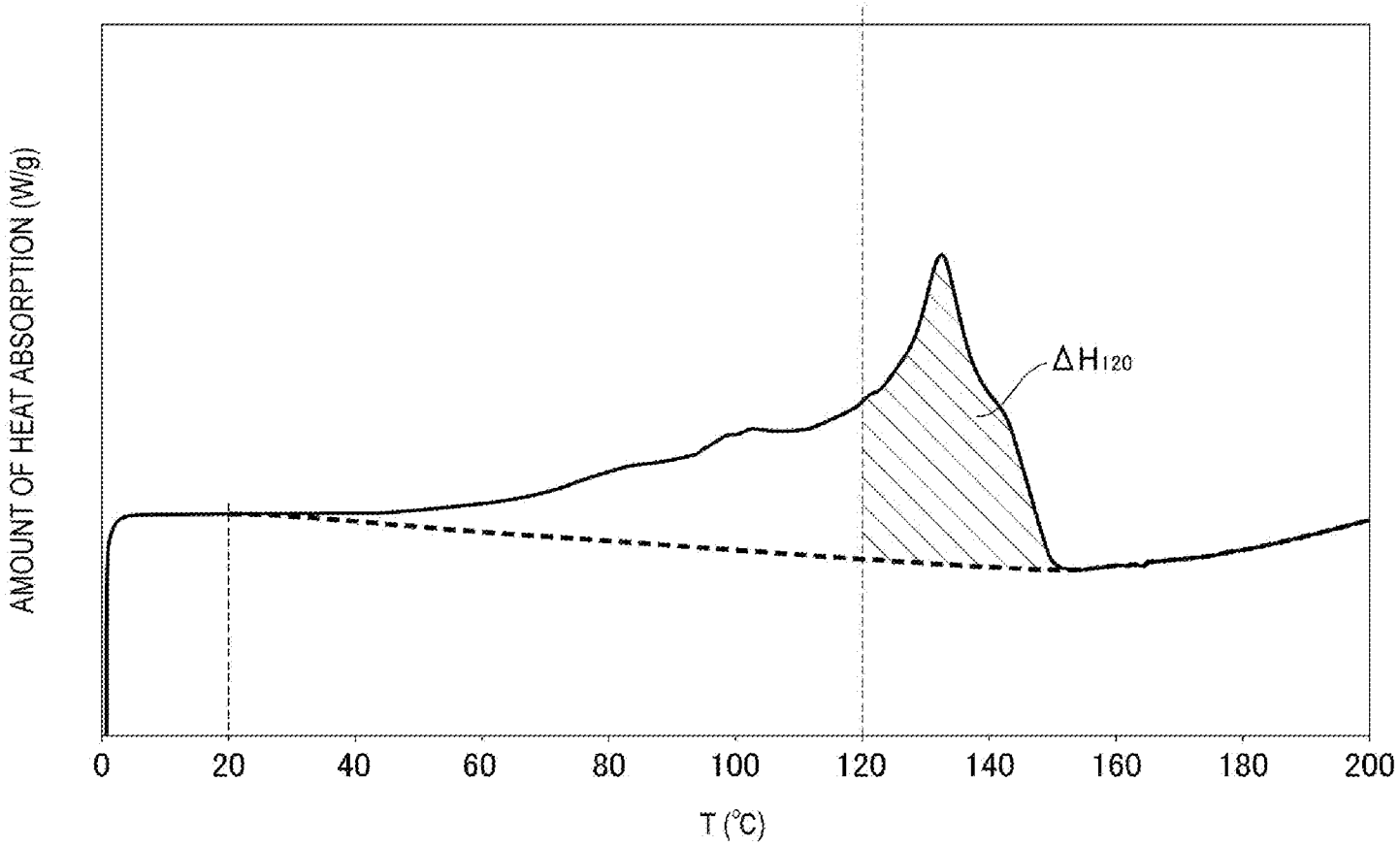
FIG. 3 is a graph for describing fusion enthalpy $\Delta H_{120}$ of a resin composition.

FIG. 3 is a graph for describing fusion enthalpy $\Delta H_{120}$ of a resin composition. In the following description, a DSC measurement method and a DSC analysis method are based on JIS K7121 "Testing methods for transition temperatures of plastics". The fusion enthalpy $\Delta H$ measured by the DSC is determined as an area of a region between a DSC curve on a peak thereof and a baseline, with a temperature T being a horizontal axis. Accordingly, as illustrated in the figure, the fusion enthalpy $\Delta H_{120}$ of the temperature range of higher than or equal to 120 degrees C. is determined as an area of a part that satisfies the following in the above-described region: temperature $T \geq 120$ degrees C. Here, the peak of the DSC curve is defined in JIS K7121 as "a part from a point where the curve moves away from the baseline to a point where the curve returns to the baseline", and the baseline is defined in JIS K7121 as " . . . the DSC curve in a temperature range where no transition and no reaction occur in a test piece". That is, the peak is the temperature range from where, after the DSC curve reaches the baseline once, the transition or the reaction starts to occur to where the transition and the reaction cease to occur. However, in the present exemplary embodiment, the peak start temperature is fixed at 20 degrees C. in view of a fact that it may sometimes be difficult to specify a temperature at which the peak starts depending on composition of the resin composition. In this case, the peak of the DSC curve would be "a part from a point where the temperature is 20 degrees C. to a point where no transition and no reaction occur in the test piece" and the baseline for determining the fusion enthalpy $\Delta H$ would be "a line from a point where the temperature is 20 degrees C. to a point of an end of the peak where no transition and no reaction occur in the test piece".

Meanwhile, the tensile modulus of elasticity is an index of resistance to deformation of the resin composition. In the present exemplary embodiment, the tensile modulus of elasticity is based on JIS K7161 "Plastics—Determination of tensile properties".

To the resin composition included in the engagement portions 22A and 22B of the zipper tape 20 according to the present exemplary embodiment, a modifier may be added. The modifier is, for example, an ethylene-propylene rubber (EPR). Besides, it is possible to use ethylene-butene-1 (EBR), propylene-butene-1 (PBR), terpolymer, and a petroleum resin as the modifier. In order to improve the flattening property, it is also desirable that a resin having small ΔH is used as a modifier.

In the present exemplary embodiment, the flattening property of the engagement portions 22A and 22B is improved by forming the engagement portions 22A and 22B of the zipper tape 20 with the resin composition described above. The improvement in the flattening property of the engagement portions 22A and 22B, which are deformed parts projecting from the base strips 21A and 21B respectively, makes it possible to perform the point sealing process at a low temperature, thereby shortening the time taken for the point sealing process or omitting the point sealing process. The point sealing process involves deforming in advance the engagement portions 22A and 22B of the zipper tape 20 in flat shapes prior to forming the side seal portion 13.

Second Exemplary Embodiment

Figure 4:
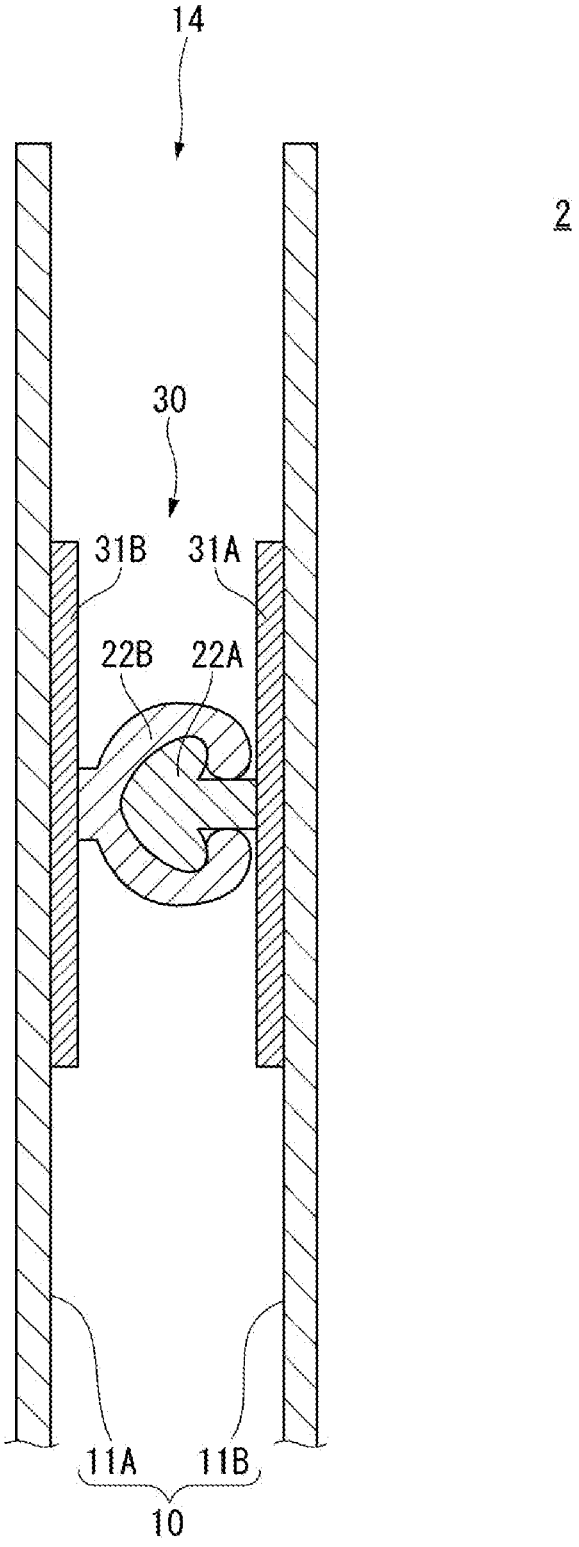
FIG. 4 is a cross-sectional view of a bag equipped with a zipper tape according to a second exemplary embodiment of the invention.

FIG. 4 is a cross-sectional view of a bag equipped with a zipper tape according to a second exemplary embodiment of the invention. As illustrated in FIG. 4, a bag 2 equipped with a zipper tape according to the second exemplary embodiment includes the film 10 and a zipper tape 30. It is to be noted that the configuration of the film 10 is similar to that of the first exemplary embodiment described above; hence, the repeated description will be omitted.

The zipper tape 30 includes: a pair of base strips 31A and 31B respectively bonded to the first side 11A and the second side 11B of the film 10; and the engagement portions 22A and 22B that project from respective opposing surfaces of the base strips 31A and 31B. The engagement portions 22A and 22B are configured similarly to those of the first exemplary embodiment described above, and are engageable with each other. The engagement portions 22A and 22B each include polypropylene and each have fusion enthalpy $\Delta H_{120}$ in a temperature range of higher than or equal to 120 degrees C. measured by differential scanning calorimetry (DSC) of less than 30 J/g and tensile modulus of elasticity of less than or equal to 600 MPa. The $\Delta H_{120}$ is preferably less than or equal to 25 J/g, and more preferably less than or equal to 20 J/g. Although a lower limit of the $\Delta H_{120}$ is not particularly limited, the $\Delta H_{120}$ is greater than or equal to 5 J/g in normal cases. The $\Delta H_{120}$ of less than 30 J/g further improves the flattening property. Regarding a combination of the $\Delta H_{120}$ and the tensile modulus of elasticity, it is preferable that the tensile modulus of elasticity is less than or equal to 500 MPa in a case where the $\Delta H_{120}$ is greater than 20 J/g and less than 30 J/g, and it is preferable that the tensile modulus of elasticity is less than or equal to 600 MPa in a case where the $\Delta H_{120}$ is less than 20 J/g. The tensile modulus of elasticity is preferably less than or equal to 400 MPa, and more preferably less than or equal to 350 MPa. The tensile modulus of elasticity of less than or equal to 600 MPa further improves the flattening property. Although a lower limit of the tensile modulus of elasticity is not particularly limited, the tensile modulus of elasticity is greater than or equal to 100 MPa in normal cases.

In contrast, the base strips 31A and 31B of the zipper tape 30 each are formed with a resin composition that is different from the resin composition of the engagement portions 22A and 22B. The resin composition forming each of the base strips 31A and 31B may or may not satisfy the conditions regarding the fusion enthalpy $\Delta H_{120}$ and the elasticity modulus similar to those of the resin composition included in the engagement portions 22A and 22B. The zipper tape 30 is formed, for example, by co-extruding the resin composition forming the engagement portions 22A and 22B and the resin composition forming the base strips 31A and 31B. The base strips 31A and 31B may each be further divided into several parts formed with different resin compositions.

Also in the present exemplary embodiment, similarly to the first exemplary embodiment, the flattening property of the engagement portions 22A and 22B of the zipper tape 30 is improved, making it possible to perform the point sealing process of the side seal portion 13 at a low temperature and thereby shortening the time taken for the point sealing process or thereby omitting the point sealing process.

EXAMPLES

Hereinafter, Examples of the invention will be described. In Examples, "Diamond DSC" available from Perkin Elmer Japan Co., Ltd. was used as the DSC, and a test piece of the resin composition was isothermally held at 0 degree C. for 5 minutes and then heated (1st Run) to 220 degrees C. at 10.00 degrees C./min, thereby obtaining a DSC curve. On the basis of the obtained DSC curve, the fusion enthalpy $\Delta H_{120}$ of the temperature range of higher than or equal to 120 degrees C. was calculated according to the above-described definitions of the peak and the baseline. The calculation of the fusion enthalpy $\Delta H_{120}$ was performed according to JIS K7121 except for the above-described conditions.

Meanwhile, the tensile modulus of elasticity was measured using "Autograph AGSX-1kN" available from Shimadzu Corporation, and was calculated according to JIS K-7161 by setting a tensile speed to 500 mm/min and a distance in the test piece (between gripping portions) to 100 mm. It is to be noted that, in a case where the distance between the gripping portions of the test piece was less than 100 mm, the calculation was performed by adjusting a load at which the test piece was in 1% strain in an equation of the tensile modulus of elasticity. In the present Examples, the tensile modulus of elasticity was calculated by: (1) tensile modulus of elasticity ($kg/cm^2$)=load (kg) at time of 1% strain of test piece/(width of test piece * thickness of test piece ($cm^2$)); and (2) tensile modulus of elasticity (MPa) =tensile modulus of elasticity ($kg/cm^2$) * 0.0980665. It is to be noted that it was not possible to define the width and the thickness in the test piece having a complicated shape such as the zipper tape described in the above exemplary embodiment. Accordingly, a cross-sectional area ($cm^2$) of the male and female engagement portions was measured instead, by using an optical microscope. Here, the cross-sectional area of the engagement portions was defined as a cross-sectional area of the engagement portions which were perpendicular to the base strips and were present between two planes including the engagement portions in a width direction. It is to be noted that the cross-sectional area was measured for each test piece due to a variation in size of cut portions of the base strips.

Regarding the bag equipped with the zipper tape according to the first exemplary embodiment of the invention described above, presence or absence of pinholes in the side seal portion was evaluated by using: resin compositions included in the engagement portions and the base strips of the zipper tapes each having the $\Delta H_{120}$ of less than or equal to 30 J/g and having the tensile modulus of elasticity of less than or equal to 500 MPa as Example 1 to Example 6; and a resin composition having the $\Delta H_{120}$ of less than or equal to 20 J/g and the tensile modulus of elasticity of less than or equal to 600 MPa as Example 7.

In the zipper tapes of Examples 1 to 7, polypropylene contained in the resin composition forming the engagement portions and the base strips were: metallocene polypropylene random copolymer (described as polypropylene A in Table 1) having a melting point of 123 degrees C. and a melt flow rate of 7.0 g/min; polypropylene (described as polypropylene B in Table 1) having a melting point of 125 degrees C. and a melt flow rate of 6.0 g/min; and polypropylene random copolymer (described as polypropylene C in Table 1) having a melting point of 131 degrees C. and a melt flow rate of 7.0 g/min. Further, the modifiers were: metallocene soft polypropylene having a density of 0.89 g/cm$^3$ and a melt flow rate of 6.0 g/(described as modifier I in Table 1), an ethylene-propylene rubber having a density of 0.89 g/cm$^3$ and a melt flow rate of 8.0 g/(described as modifier II in Table 1), and an ethylene-propylene rubber having a density of 0.88 g/cm$^3$ and a melt flow rate of 8.0 g/(described as modifier III in Table 1). The zipper tapes were each fabricated by extruding a raw material composition obtained by using one of the above materials or by mixing the above materials at a predetermined ratio, followed by water-cooling. It is to be noted that the melting point of each material was calculated by subjecting the fabricated zipper tape to the DSC described above for each of the materials.

In contrast, fabricated as Comparative examples 1 to 4 were zipper tapes each including a resin composition in which either or both of the $\Delta H_{120}$ and the tensile modulus of elasticity deviated from the ranges of Examples 1 to 6. Further, as Comparative example 5, a zipper tape was fabricated using a resin composition having the tensile modulus of elasticity of 518 MPa and the $\Delta H_{120}$ of 30 J/g, following which the zipper tape was bonded to a film similar to that of the first exemplary embodiment to thereby obtain a bag equipped with the zipper tape.

Table 1 indicates results of evaluating a lowest point sealing temperature (a lowest flattening temperature) at which no pinhole occurs in Examples 1 to 7 and Comparative examples 1 to 5. The evaluation method is as follows.

Conditions for Manufacturing Bag

Using a three-side-press-seal, automatic pouch making machine "BH-60HV" available from Totani Corporation and a laminate film of OPP #30/CPP #40, evaluation samples for the zipper tapes and the laminate films of Examples 1 to 7 and Comparative examples 1 to 4 were obtained. The following conditions were set as common sealing conditions: two steps of point sealing, two steps of side sealing, two steps of cooling the side sealing, a sealing time of 0.25 seconds, acceleration of 0.6 G, a standby time of 0 second, a feed length of 160 mm, a zipper sealing temperature of 150 degrees C., and a side sealing temperature of 150 degrees C. A point sealing temperature was appropriately varied. The flattening properties of the test samples were evaluated by the lowest flattening temperature. In Table 1, "GOOD" indicates the lowest flattening temperature of lower than 180 degrees C., "FAIR" indicates the lowest flattening temperature of higher than or equal to 180 degrees C. and lower than 190 degrees C., and "POOR" indicates the lowest flattening temperature of higher than or equal to 190 degrees C. and lower than 200 degrees C.

Presence or Absence of Pinholes

Presence or absence of pinholes in the side seal portion was evaluated by filling ink-colored alcohol in each of the bags equipped with the zipper tapes of Examples 1 to 7 and Comparative examples 1 to 5. The lowest flattening temperature indicated in Table 1 is a point sealing temperature at the point where the alcohol stops leaking, obtained by increasing each of the two steps of point sealing temperature by 5 degrees C. in a case where the colored alcohol leaks from the side seal portion.

TABLE 1

Table 1: Examples and Comparative examples

| | Polypropylene | Modifier | Blend ratio (polypropylene:modifier) | $\Delta H_{120}$ (J/g) | Tensile modulus of elasticity (MPa) | Lowest flattening temperature (° C.) | Evaluation of flattening property |
|---|---|---|---|---|---|---|---|
| Example 1 | A | III | 60:40 | 14 | 431 | 165 | GOOD |
| Example 2 | B | I | 30:70 | 28 | 311 | 175 | GOOD |
| Example 3 | B | II | 30:70 | 15 | 437 | 175 | GOOD |
| Example 4 | B | III | 70:30 | 20 | 361 | 175 | GOOD |
| Example 5 | B | III | 60:40 | 16 | 321 | 165 | GOOD |
| Example 6 | C | III | 50:50 | 20 | 284 | 170 | GOOD |
| Example 7 | A | III | 70:30 | 16 | 546 | 175 | GOOD |
| Comparative example 1 | A | — | 100:0 | 27 | 846 | 185 | FAIR |
| Comparative example 2 | C | — | 100:0 | 44 | 516 | 195 | POOR |
| Comparative example 3 | A | II | 70:30 | 21 | 675 | 180 | FAIR |
| Comparative example 4 | C | I | 70:30 | 36 | 395 | 180 | FAIR |
| Comparative example 5 | B | — | 100:0 | 30 | 518 | 185 | FAIR |

Preferred exemplary embodiments of the invention have been described above in detail with reference to the accompanying drawings, but the invention is not limited to such exemplary embodiments. It is apparent that a person having ordinary skill in the art of the invention can arrive at various alterations and modifications within the scope of the technical idea recited in the appended claims, and it is understood that such alterations and modifications naturally fall within the technical scope of the invention.

The invention claimed is:

1. A zipper tape having an elongated shape, the zipper tape comprising, in a cross-sectional shape thereof:

a pair of base strips; and engagement portions projecting from respective opposing surfaces of the pair of base strips and being engageable with each other, wherein at least the engagement portions each are formed with a resin composition including polypropylene, the resin composition having fusion enthalpy $\Delta H_{120}$ in a temperature range of higher than or equal to 120 degrees C. measured by differential scanning calorimetry (DSC) of less than 30 J/g, and having tensile modulus of elasticity of less than or equal to 600 MPa.

2. The zipper tape according to claim 1, wherein the fusion enthalpy $\Delta H_{120}$ is less than 30 J/g and the tensile modulus of elasticity is less than or equal to 500 MPa, or the fusion enthalpy $\Delta H_{120}$ is less than 20 J/g and the tensile modulus of elasticity is less than or equal to 600 MPa.

3. The zipper tape according to claim 1, wherein the fusion enthalpy $\Delta H_{120}$ is greater than 20 J/g and less than 30 J/g and the tensile modulus of elasticity is greater than or equal to 100 MPa and less than or equal to 500 MPa, or the fusion enthalpy $\Delta H_{120}$ is greater than 5 J/g and less than or equal to 20 J/g and the tensile modulus of elasticity is greater than or equal to 100 MPa and less than or equal to 600 MPa.

4. The zipper tape according to claim 1, wherein the resin composition further includes a modifier.

5. The zipper tape according to claim 4, wherein the modifier includes an ethylene-propylene rubber (EPR).

6. The zipper tape according to claim 1, wherein at least a part of the base strips is formed with a resin composition that is different from the resin composition forming the engagement portions.

7. A container equipped with a zipper tape comprising:

the zipper tape according to claim 1; and a container body to which the zipper tape is bonded.

8. The container equipped with the zipper tape according to claim 7, wherein the container body forms a bag body.

* * * * *